United States Patent [19]

Wiechowski et al.

[11] 4,244,768

[45] Jan. 13, 1981

[54] METHOD OF MANUFACTURING A GRATING CONSTRUCTED OF RESIN BONDED FIBERS

[76] Inventors: Joseph W. Wiechowski, 420 Avenida Salvador, San Clemente, Calif. 92672; Delmar S. Miller, 918 W. Balboa Blvd., Newport Beach, Calif. 92661; Richard C. Kostner, 2060 Agate St., Orange, Calif. 92667

[21] Appl. No.: 863,766

[22] Filed: Dec. 23, 1977

[51] Int. Cl.[3] ..... E04C 2/22; E04C 2/42

[52] U.S. Cl. ..... 156/293; 52/180; 52/181; 52/667; 156/279; 156/305; 156/330; 156/303.1

[58] Field of Search ..... 156/293, 294, 279, 305, 156/65, 152, 310, 330, 180; 264/112; 52/662, 667, 181, 311, 108, 180; 29/603

[56] References Cited

U.S. PATENT DOCUMENTS

| | | | |
|---|---|---|---|
| 2,190,214 | 2/1940 | Nagin | 52/667 |
| 2,846,931 | 8/1958 | Priest | 52/667 |
| 2,960,918 | 11/1960 | Nagin | 52/181 |
| 2,960,919 | 11/1960 | Nagin | 52/181 |
| 3,010,045 | 11/1961 | Plagge et al. | 156/293 |
| 3,385,744 | 5/1968 | Van Sciver | 156/310 |
| 3,556,888 | 1/1971 | Goldsworthy | 156/180 |
| 3,688,056 | 8/1972 | Wiseley et al. | 29/603 |
| 3,710,529 | 1/1973 | Pass | 52/108 |
| 3,772,419 | 11/1973 | Schoening | 264/112 |

*Primary Examiner*—Michael G. Wityshyn
*Attorney, Agent, or Firm*—Knobbe, Martens, Olson, Hubbard & Bear

[57] ABSTRACT

A resin bonded glass fiber grating adhesively bonded together in unitary construction to form a lightweight, high strength industrial grating, which may include a non-skid elastomer surface and the capability to be rolled up for storage and a method of constructing the same.

17 Claims, 15 Drawing Figures

FIG. 1.
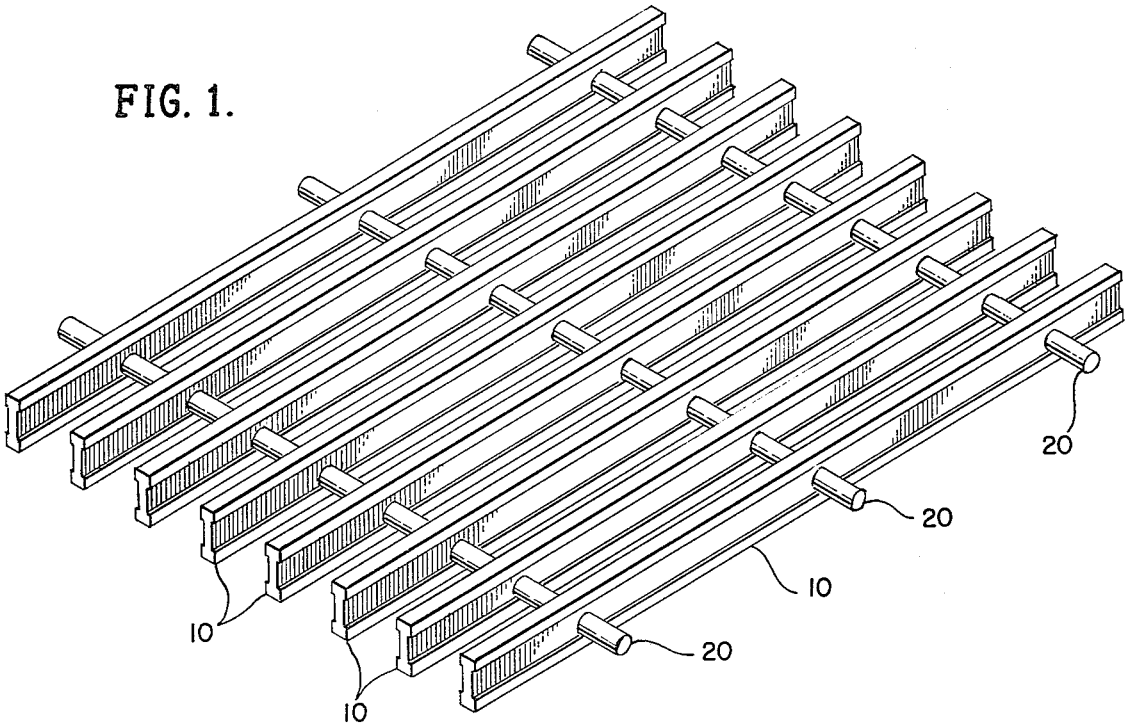
FIG. 2.
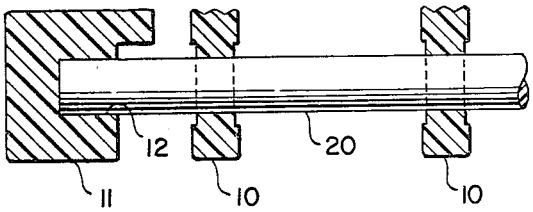
FIG. 3.
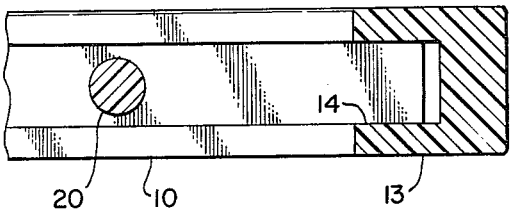
FIG. 4.
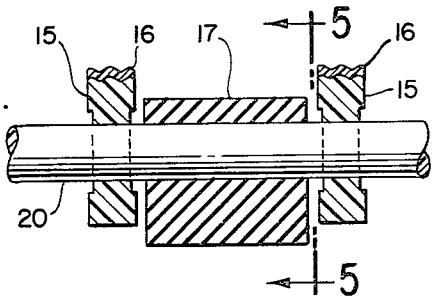
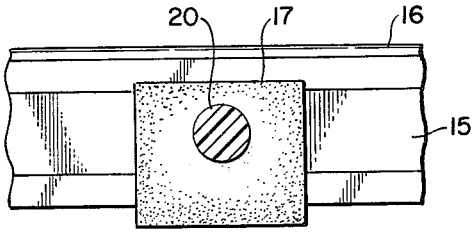
FIG. 5.
FIG. 6.
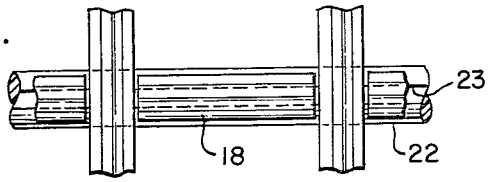
FIG. 9.
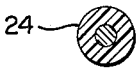
FIG. 8.
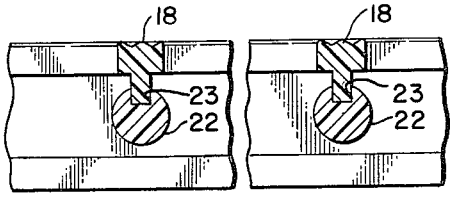
FIG. 7.
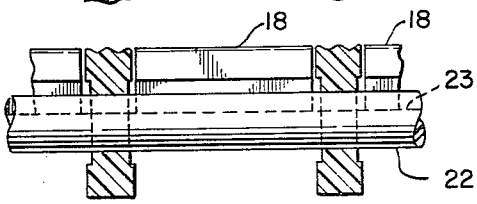

FIG. 12.
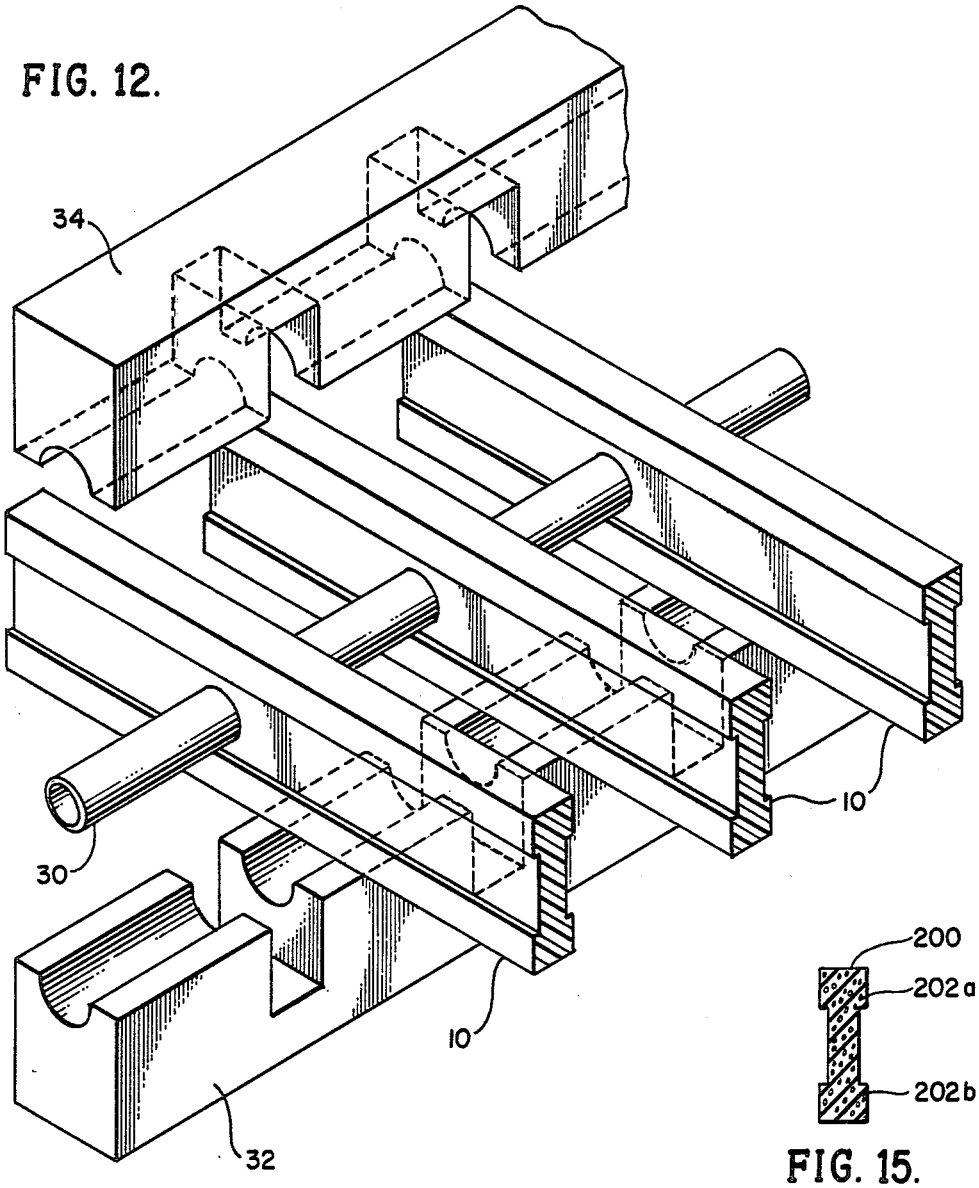
FIG. 15.
FIG. 13.
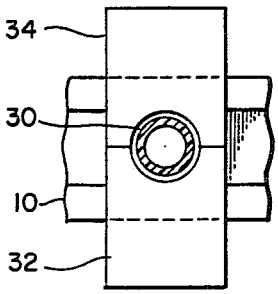
FIG. 14.
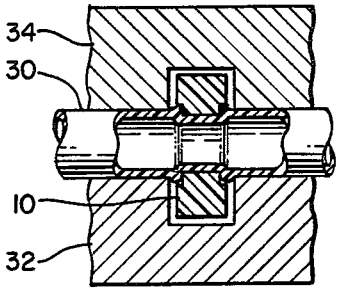

METHOD OF MANUFACTURING A GRATING CONSTRUCTED OF RESIN BONDED FIBERS

This invention relates to industrial gratings, typically used in floor construction to provide covering for drain and cleaning channels, in animal production, food processing and other floor constructions. The grating constructions of this invention may also be used to support gas-liquid and solid-gas or solid-liquid contact media, e.g., scrubber saddles, rings and the like, in chemical process equipment. More particularly, this invention relates to an improvement in polyester bonded glassfiber gratings and to a method of manufacture.

It is common practice in industrial establishments to provide drain and cleaning channels in floors which permit scrubbing and cleaning of the floors and collection of cleaning solutions and spilled industrial solutions into an open drain channel. These drain channels are typically covered with a steel grating. The gratings, typically, are in a grid configuration. This type of construction permits the maintenance of clean working and processing conditions, easy access to drainage channels and, in general, an improved working area. Steel gratings are, of course, heavy and difficult to handle. Additionally, they are subject to corrosion by repetitive contact with water and air and by virtually all processing solutions. Steel gratings are, of course, electrically conductive, and in some environments present electrical shock hazards. Steel gratings are also cold and have limited flexibility and generally do not provide a pleasant walking surface. All of these and other disadvantages of steel gratings have been long recognized. Nevertheless, steel gratings are still in common use and a fully satisfactory alternative has not generally been available.

The modern approach to pork production is to place young porkers in close quarters on a grating so that, essentially, all the porkers do is to eat and sleep. Effective production by this approach requires that quarters be cleaned regularly. Accordingly, it is the usual practice to place the porkers on a steel grating floor and regularly, usually daily, to flush the entire area, porkers and all, with a wash solution which cleans the entire environment in which the porkers are raised. Typically, the wash solution includes a detergent and in most instances will include biostatic or biocidal agents and may include builders. The net effect of the animal waste and the washing solution contact regularly with the grating floor, coupled with constant abrasion with the hoofs of the porkers is that steel gratings are only marginally satisfactory for this purpose since they corrode rapidly and frequent replacement is required.

Various attempts have been made to provide plastic coated gratings or plastic gratings. For example, one approach is to lay alternating layers of fiberglass roving in a recess form and to pourcast polyester bonding resin over the fibers. Sometimes abrasive particles are bonded to the grating or may be included in the original casting of the grating in the obvious manner by placing the abrasive particles in the bottom of the form and then casting the resin over the fibers and the particles. This process produces only a marginally satisfactory product and is infected with a number of serious disadvantages. For example, gratings of this type have no drainage channel if the grating is laid flat on a floor, as is frequently the case in, for example, food processing plants. Additionally, the area of intersection of the portions of the gratings is an area of weakness because of the disruption of the fiber resin bonding and the asymmetrical disposition of the resins in this area. Gratings constructed according to this method are unnecessarily bulky and heavy and like the earlier devices, do not permit drainage.

These and other disadvantages are overcome according to this invention by the construction of a lightweight, high strength grating using the principles taught hereinafter.

One of the features of this invention is that minimum material, and consequently minimum weight, is utilized to produce a very high strength grating.

Another feature of the invention is that the gratings produced according to this invention inherently have one-way drainage and in certain embodiments of the invention are two-way draining.

Another feature of the invention is that brightly colored gratings may be produced without the hazard of flecking paint or coating which tends to contaminate industrial food products if an attempt is made to paint or coat gratings of the prior art.

Another feature of the invention is that a non-skid, elastomeric layer can be unitarily incorporated into the grating structure to provide a comfortable, safe working support in industrial and food processing plants. Abrasive particles such as silica, aluminum oxides, carborundum grit or the like may also be used to provide a non-skid surface if proper techniques and care are used in adhereing the non-skid particles to the grating surfaces.

Another feature of the invention is that nose pieces and other particular portions of the grating may be made of different colors than the material of which the remainder of the grating is constructed, thus highlighting the edges of stairways, hazardous areas, and the like.

Another feature of the invention is that in particular embodiments the grating can be rolled up for shipping and storage.

Another feature of the invention is that the grating includes no exposed metal and, consequently, is free of all corrosion problems, polyester bonded or epoxy bonded fiberglass gratings being virtually immune to all common chemical corrosives.

In another aspect of the invention, a system is provided for assembling the grating in a highly efficient and economical manner.

In one feature of the invention, apparatus is provided for automatically fabricating and manufacturing grating of the type described and claimed herein in an efficient and effective manner.

A process of manufacture and fabrication constitutes one important facet and feature of the present invention.

These and other advantages and features flow from this invention and will be apparent to those skilled in the art from the drawings referred to herein and from the following specification, all of which are exemplary and not limiting, the scope of the invention being defined only by the claims appended to the specification.

IN THE DRAWINGS

FIG. 1 is a perspective showing a section of a grating constructed according to the principles of this invention.

FIG. 2 is a cross-sectional view of a typical edge of a grating constructed according to the principles of this invention.

FIG. 3 is a cross-section view of the end of a typical grating constructed according to the principles of this invention.

FIG. 4 is a cross-sectional view of a portion of an alternative embodiment of the grating constructed according to this invention, including a skid-proof surface and featuring two-way drainage.

FIG. 5 is a cross-sectional view of the embodiment of FIG. 4 taken along lines 5—5 in the direction of the arrows as shown in FIG. 4.

FIG. 6 depicts another alternative construction of the grating constructed according to this invention providing a complete upper grid surface, FIG. 6 looking down upon the top of the grating.

FIG. 7 is a side view of the grating shown in FIG. 7.

FIG. 8 is an end view of the embodiment depicted in FIGS. 6 and 7 taken perpendicularly to the view of FIGS. 6 and 7, showing the grid pieces interfitted into the dowel pieces.

FIG. 9 shows an alternative to the standard dowel construction as used in this invention.

FIGS. 12, 13 and 14 show the steps of one method of assembly according to this invention and the apparatus used in such assembly for the manufacture of one form of the inventive grating.

FIG. 15 is a cross-section of a grating beam having increased resistance to splitting.

Figure 10:
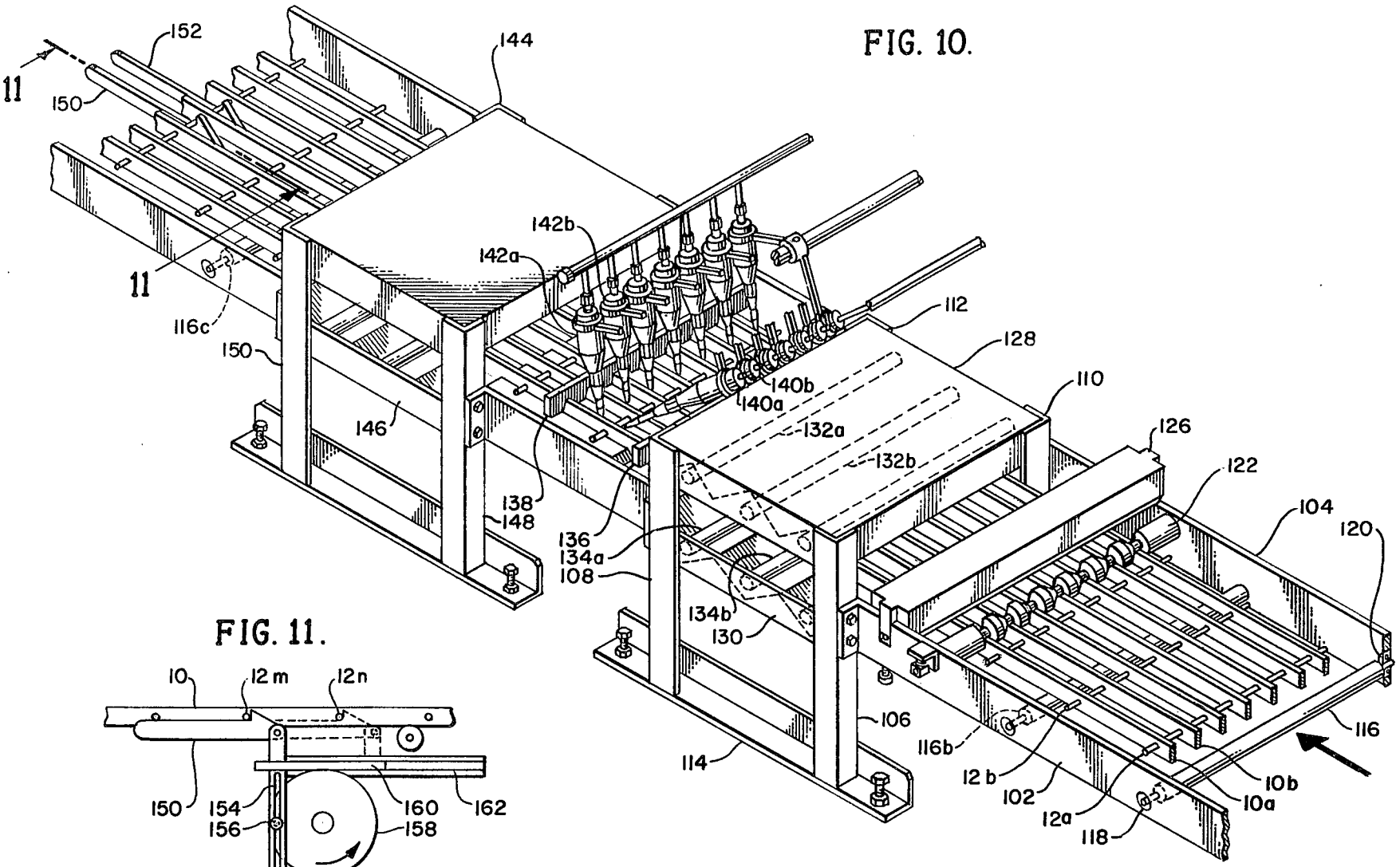
FIG. 10 is a perspective view of an apparatus of the invention for assembling the inventive grating constructions in a highly efficient manner.

The invention is disclosed by means of a non-limiting exemplary depictions. Reference is made first to FIG. 1 which shows a portion of a typical grating constructed according to this invention. The typical grating includes a plurality of vertical elements referred to generally by the numeral 10 connected together in a grating construction by a plurality of dowel-like elements indicated generally by numeral 20. The elements 10 may be perfectly rectangular in configuration but in the preferred embodiment are generally in the configuration of an "I" and, for that reason, are referred to merely for convenience hereinafter as I-elements. As used herein the term I-element includes rectangular grating elements not formed in a I configuration. Likewise, the elongate round elements are referred to as dowels for convenience. The I-elements, in the typical embodiment, are from about ¾ inch to about 2 inches in vertical height and from about ¼ inch to about ½ inch in overall width. The central web portion of the I-element is generally from 60 to 90%, and may, of course, be 100% the width of the overall I-element.

The dowel element 20 is typically from 3/16 inch to ½ inch in diameter and, in the embodiment depicted in FIG. 1, is relatively rigid, although dowels of this construction inherently have, as will be apparent from the discussion hereinafter, substantial flexibility.

Considerable experimental work was done on constructions generally of the type depicted in FIG. 1. Efforts were made, for example, to secure the various elements of the grating together using steel or other metal pins, or using other fasteners. The resulting product was not completely satisfactory, the assembly process was expensive and cumbersome and the pins were subject to corrosion. One of the features of this invention, and an important feature, is the method of constructing gratings according to the principles described herein.

Both the I-element and the dowel are initially constructed according to the pultrusion method of forming resin bonded fiberglass elements.

According to this method, fibers are intimately mixed with a bonding resin and pulled through a curing zone on a continuous basis to form the final product. Generally speaking, glass fibers are used and that is the general context of this disclosure. However, other fibers, including metal strands, may be included to impart particular characteristics. Graphite fibers and polyester fibers may, for example, be incorporated into the pultrusion produced I-element or dowel in particular instances.

Polyester and epoxy organic resins are the preferred bonding materials for forming a rigid element, such as the I-element or dowel, by bonding the fibers together. Polyester bonding of glass fibers, as a fabrication technique, is well-known. While less commonly used, epoxy is also well-known as a bonding material for forming glass fiber reinforced particles. The technique for formulations and applications of these resins to produce various types of structures is well-known in the art and abundant descriptive information is available. Methods for forming elongate glass fiber reinforced structures generally of the type described herein are also well-known. The pultrusion method, for example, is quite well-known and various techniques for using this method in the fabrication of elongate articles has been described. See, for example, U.S. Pat. Nos. 3,556,888 and 3,674,601. The method has also been described in various technical publications; see, for example, Modern Plastics Encyclopedia, for the past several years, e.g., 1973–1976, wherein several articles on this technique have appeared. Fibers, bonding resins, techniques and equipment generally suitable for producing the I-element and dowels used in the manufacture of the gratings of this invention are widely described in the literature see, e.g., Plastics Engineering Handbook, 4th Edition, Frados, Van Nostrand-Reinhold Company, New York, 1976.

Briefly, in the pultrusion technique, the desired number of strands or rovings of fiber of the desired type are pulled from continuous reels through a reservoir of the bonding resin and over strippers, rollers and dies to intimately intermix the resin with the fibers and to remove the excess resin. The fibers, intimately coated with resin, are then progressively combined together and ultimately pulled through a form of the size and shape of the ultimate element to be manufactured. As the combination of resin and fibers emerges from the form, it is in substantially the ultimate shape of the element. The combined resin-fiber configuration is then pulled through a curing zone where the resin is heated by radiant heat, circulating heat or some other heating technique. Microwave heating, with or without x-ray, gamma ray or electron radiation, is also used to cure the resin in a relatively short zone. The cured resin is then pulled into a cooling zone and is ultimately cut into the desired length or rolled, as may be desired.

In a simple manufacturing operation, the grating shown in FIG. 1 can be manufactured by forming a plurality of I-elements which are then positioned in parallel relationship, drilling holes substantially equal in diameter to the diameter of the dowels 20 in registry through the I-elements and then inserting the dowels through the holes in registry and spacing the I-elements. Thus far, the process is rather straightforward but the bonding technique between the dowel and the I-element has presented very difficult practical and technical problems. Superficially, it may appear that adhesion bonding is a feasible manufacturing technique. Experience has shown, however, that adhesives do not ordinarily penetrate sufficiently to provide a firm bond. Consequently, earlier efforts have been directed toward a mechanical fastener between the dowel and the I-element. One of the features of this invention is a technique for forming a permanent, high strength bond between the dowel and the I-element.

According to this feature of the invention, the dowels are not pushed totally to their maximum extent as they exist in the ultimate construction of the grating but, rather, are left out of the I-element a short distance, e.g., ⅛ inch. The distance will vary depending upon the thickness of the I-element. For example, the distance will vary from approximately 1/16 inch for a very thin I-element to up to ½ inch or more, i.e., about ½ the thickness of the I-element, for a thick element. A predetermined amount of adhesive is applied to the dowel adjacent to the I-element, i.e., to that portion of the dowel which ultimately will be inside the I-element. Adhesive suitable for the bonding required are not sufficiently fluid to permit a strong bond to be formed by simply pushing the dowel further into the I-element at this state. Rather, it is necessary to raise the temperature of the dowel and the adhesive before inserting the dowel further into the I-element. As the temperature of the dowel, the I-element and the adhesive reaches approximately 140°, subject to some considerable variation depending on the specific adhesive, the dowel is then moved quickly to the final position to aid in the capillary flow of the adhesive to all portions of the dowel-I-element contact zone. The adhesive is a low viscosity fluid at this temperature and flows around the dowel and wets the surface of the dowel and the interior surface of the drill through the I-element and makes a very hard permanent high strength bond between the dowel and the I-element. The grating is cooled and the resulting product is held at ambient room temperature for several hours to permit complete cure at which time the grating is ready for ultimate use.

The process can also be carried out without moving the dowels after the application of the adhesive, relying upon the capillary flow of adhesive at about 140° F. to cause the adhesive to flow between the surface of the dowel and internal surface of the hole through the I-element. This technique is satisfactory but provides a less strong bond than the technique previously described. In this variation of the process of this invention, the preferred procedure is to pre-heat the grating assembly at a station immediately before the glue application station, such that the grating components are all at a temperature higher than the optimum low-viscosity flow temperature of the glue, typically about 140° F., when the glue is applied. The glue is maintained, or raised if applied at a lower temperature, to its low-viscosity flow temperature and flows essentially instantly by capillary action into the small space between the dowel and the interior of the hole through the beam, thus filling the space entirely, forming a strong adhesive bond and filling all spaces which might otherwise be a site for collection of dirt or breeding of bacteria.

The adhesive used in this process is a high viscosity material at room temperature and has a very long pot life, the latter being an essential for any industrial production. When raised to a temperature above about 140° F., its viscosity reduces rapidly and it becomes a low viscosity fluid which readily wets polyester and epoxy bonded glass fiber surfaces and flows by capillary action into joints between the dowel and the I-element. The preferred adhesive is an epoxy sold under the tradename Epon, specifically Epon 815, 820 or 872, by Shell Chemical Company. Mixtures of these may be used. The curing agent is latent boron trifluoryde amine complex sold by Pacific Anchor under the trademark Anchor 1170, 1171, 1040, 1215 and 1222. Varying viscosities and set times can be obtained using these epoxies and curing agents.

The preferred formulation is 100 parts of resin to 5 parts of curing agents. Anchor 1171, mixed in a ratio of 5 parts per 100 parts of epoxy forms a catalyzed adhesive which has a stable pot life at room temperature of 12 hours, an activation temperature of 140° F., a fixturizing cure under heat of from 10–20 seconds and which forms a strong rigid bond, with a final cure to ultimate strength at ambient room temperature within 24 hours.

One of the important features of this invention is that gratings can be made in a great variety of styles, types and color configurations, For example, FIG. 2 shows in partial cross-section a grating which includes the dowel 20, a plurality of I-elements 10 and an edge element 11 which has a larger cross-sectional area and consequently, has a greater strength. In the configuration shown in FIG. 2, the edge element includes a dead end bore opening 12 into which the end of the dowel 20 extends and terminates. The "dowel" 20 may be composed of any of a large number of materials and combinations of materials, some of which are specifically described hereinafter and some are depicted in the drawings. In general, the dowel 20 may be a rigid or flexible thermosetting resin bonded glass, nylon or other fiber reinforced rods, rigid or flexible thermoplastic bonded glass, nylon or other fiber reinforced rods or resin bonded or coated metal fiber reinforced rods.

Another construction of the grating of this invention is shown in FIG. 3 in which the ends of the I-elements 10 are capped with an end piece 13 in a generally U-shaped configuration, the ends of the element 10 extending into the opening of the U configuration 14 and terminating therein, thereby protecting the ends of the I-elements and providing a more rigid and stronger construction of the grating.

In many applications it is desirable, and sometimes required by law, to have contrasting colors at various points. For example, it is highly desirable, and, in some types of operations legally required, to have a contrasting color at the edge of each step or at the end of a particular section. In such instances, the elements 11 and 13 can be made of a constrasting color, for example, bright orange or bright yellow to indicate the edge of the steps or the edge of the grating. individual I-elements may, of course, be colored differently according to pigment included in the polyester bonding resin as is common practice in the pultrusion technique.

FIGS. 4 and 5 show another alternative construction. In this construction, the dowel 20 extends through a plurality of I-elements 15 each of which, or some of which, include a layer 16 of an elastomer bonded to the top of the I-element to provide a non-skid resilient walking surface on the top of the grating. in addition, a spacer supporter element 17 is provided between each of the I-elements, or some of the I-elements, through which the dowel extends, to provide a support for the grating above the surface upon which the grating is supported. It will be apparent that the grating has inherent one-way drainage. For example, in FIG. 1, the grating will inherently drain to the lower left and the upper right as that figure is viewed since there is no obstruction to the drainage of fluids along the length of the grating parallel to the extension of the I-elements. The advantage of the grating of FIGS. 4 and 5 is that the support element 17 holds the entire grating above the floor and permits drainage in all directions. The support element 17 may be made of a rigid resin-bonded glass fiber construction but in a preferred embodiment is made of a resilient material such as particle filled rubber, i.e., a rubber product comparable to that of which automobile tires, are manufactured to support the grating resiliently above the floor and also provide four-way drainage. This combination of resilient support for the grating and a resilient upper layer on each of the I-elements provides a soft, comfortable walking and standing surface which is extremely important in many industries. For example, in the food industry, it is necessary for the workers to stand adjacent food processing and sorting equipment for several hours at a time. Serious foot and leg problems can be caused by prolonged standing on a hard surface, such as a concrete floor. One major difficulty with certain prior art gratings is that abrasive particles which are resin bonded to the grating break loose leaving a hole which may be difficult to clean and become a source of bacterial growth. In addition, the particles or, in the case of unprotected glass fiber gratings, particles containing glass fibers may find their way into food or other products and constitute a constant source of potential contamination to the product being manufactured or canned. The present invention obviates all of these major problems by providing a safe, resilient and comfortable standing surface which also permits complete cleaning and complete drainage.

FIGS. 6, 7 and 8 depict an alternative embodiment of the invention which provides a greater upwardly exposed supporting surface. In this embodiment, the dowel 22 is provided in its upwardly facing portion with a keyway 23. A plurality of surface cross members 18 are fitted into the keyways perpendicularly to the I-elements of the grating. these surface cross members extend upwardly to the same plane as the top of the grating and thus, provide additional footing and support for walking. These surface cross members and the I-elements may also include the resilient upper layer as described in connection with FIGS. 4 and 5. These surface cross members are bonded into the dowels substantially in the manner previously described for the manufacture of the grating per se; i.e., the high viscosity adhesive is applied to the surface cross member, the cross member is placed adjacent the keyway and inserted partially therein, the entire structure in the vicinity of the surface cross member is heated to approximately 140° and the surface cross member is then inserted into the keyway where the adhesive becomes a low viscosity highly wetting fluid which coats the interior surface of the keyway and the surface of the surface cross member and then sets in a matter of a few seconds.

FIG. 9 depicts an alternative embodiment 24 of the dowel. In this embodiment, a circular body of semi-rigid resin, e.g., elastomeric polyurethane bonded fiberglass is formed by the pultrusion method around a roving or rope of fibers of glass, nylon, polypropylene, or the like or a metal wire or cable or the like resulting in a dowel which is sufficiently bendable and flexible to permit the grating to be rolled up but sufficiently rigid to hold the I-element upright in use. This dowel may be substituted, for example, for the dowel 20 in the FIG. 1 configuration in which case the grating could be rolled from the lower right to the upper left of that figure as viewed to permit the grating to be stored in much less lateral space than is required for a flat grating. This permits convenient shipping and handling of gratings and storage in certain instances where the gratings are not permanently in use. In certain instances, the ability to roll a grating makes the difference between utilizing the grating or resorting to an alternative structure. For example, in chemical processing apparatus access to the interior is often only by way of a port or manhole of limited size. In such instances, it is extremely important that a grating be capable of being rolled to fit, when rolled, through the port or manhole. The rolled grating is then unrolled inside the vessel and there used, for example, to support balls, rods, saddles, or other contact surfaces which may or may not include catalytic properties. Fractionation columns, cracking chambers, etc., for example, may include a packing supported by a grating of the type described herein.

The following examples, as well as the preceding description and the drawings, depict and exemplify the invention but are not limiting as to the scope of the inventive concept, the scope of the invention being as defined in the claims appended to this specification.

Adhesive Formulations

The following formulations of EPON (Trademark of Shell Chemical Company) Resin No. 815 and Resin No. 872 epichloro-hydrin/bisphenol-A epoxy resins and Pacific Anchor Chemical Corporation type 1171 boron trifluoride-amine complex epoxy curing agent were prepared to provide varying viscosity adhesive compositions. All were found to be satisfactory, and selection of a particular viscosity blend depends upon the type of applicator being used and the personal preference of the operator.

| Formulation # | 1 | 2 | 3 | 4 | 5 |
|---|---|---|---|---|---|
| Parts of EPON 815 | 50 | 50 | 50 | 50 | 50 |
| Parts of EPON 872 | 12 | 8 | 6 | 4 | 2 |
| Parts of Anchor 1171 | 2.5 | 2.5 | 2.5 | 2.5 | 2.5 |

EPON 815 has a viscosity of about 5 to 7 poises at 25° C. while EPON 872 has a viscosity of about 15 to 30 poises A.S.T.M. D445, when heated and is a semi-solid at ambient temperature.

EXAMPLE 1

Pre-assembled gratings were pre-heated to approximately 200° V., adhesive of the respective formulations was applied to a ⅜ inch dowel at each intersection of the dowel will the I-beam element across the grating width, 36 inches, 30 intersection, by metered dispensers. The dowel rod was immediately twisted and pushed into the I-beam such that the adhesive was evenly distributed around the rod in the aperture in the I-beam. The adhesive was allowed to set as the grating was indexed to the next position where the process was repeated with the next dowel rod.

EXAMPLE 2

The same compositions were applied to gratings which were fully assembled and pre-heated to above 140° F., the glue immediately flowed into the space surrounding the dowel rods and filled that space, forming a strong bond and eliminating all space between the dowel and the beam.

The preceding process can be described in summary fashion as the steps of extending a plurality of dowels, which are normally disposed in parallel relationship, through registered apertures in a plurality of I-elements, the I-elements usually also being disposed in parallel relationship, applying to the dowels adjacent the I-elements a heat setting adhesive which has a pot life at ambient temperature long enough for practical working, e.g., an hour or more, the adhesive becoming highly fluid for several seconds, e.g., from 3 to 30 seconds or more, when heated to a flow temperature, generally above 100° F., before setting very rapidly, in several seconds, e.g., 2 seconds to 30 seconds, to form an adhesive bond between the exterior surface of the dowel and the interior surface of the I-element. The cross-sectional size and shape of the dowels are substantially the same as the cross sectional size and shape of the apertures in the I-elements. Once the dowels and I-elements are in place and the adhesive applied to the dowel elements adjacent the I-elements, the entire structure, i.e., the intersection and the adhesive, is heated to the flow temperature which, in the exemplary embodiments, is about 140° F. When the flow temperature is reached, the adhesive becomes highly fluid, wets the surface of both the dowel and the interior of the apertures in the I-element and flows by capillary action into the space between the I-element and then after several seconds, sets to form a strong bond. The bond strength is maximized by allowing the structure to set for several hours, 24 hours usually being sufficient at ambient temperature, to accomplish a complete cure of the adhesive resin.

The essential characteristics of the adhesive are that it must have a long pot life of about an hour or more at ambient temperatures, become highly fluid for several seconds when heated to a flow temperature of about 100° F. and then, at the same flow temperature or higher, set in several seconds to form a rigid bond sufficient to permit handling of the bonded structure. In the preferred embodiment, the adhesive flow temperature is about 140° F., but varying flow temperatures of from about 100° F. or higher to about 300° F. may be obtained by formulating the adhesive using varying porportions of curing agents in the adhesive. Manufacturers of resins and curing agents provide sufficient guidance in their technical literature to permit one skilled in the art to arrive at an appropriate formulation once the principles of this invention are explained. Proper pot life, flow temperature and flow time before setting can be obtained with minimal experimentation based upon the manufacturer's literature.

The most preferred form of this process significantly increases the certainty and the strength of the bond between the dowel and the I-elements. In this preferred form of the process, the dowels are not positioned in their final location relative to the I-elements, but, rather, are not fully inserted into the I-element apertures. For example, in a typical embodiment, the dowels may be inserted all but about $\frac{1}{8}$ inch from their final position, the adhesive, which is highly viscous and remains in place at ambient temperature is applied to the dowel adjacent the I-element in this $\frac{1}{8}$ inch area, then the combination of the dowel, I-element and adhesive is raised to the flow temperature and during the flow period the dowel is pushed to its final position relative to the I-element, i.e., pushed inwardly approximately $\frac{1}{8}$ inch. This aids the capillary flow of the adhesive and forms a more uniform and more reliable bond between the dowel and the I-element.

The bond between the dowel and the I-element is substantially as strong as the bonding of the fibers one with another and, therefore, the resulting grating is of substantially uniform strength throughout. This uniform, high and reliable strength bond makes the difference between a successful polymer bonded fiber grating and earlier unsuccessful attempts. The entire grating is virtually immune to all corrosion and is free from weaknesses inherent in earlier bonding efforts. Thus, a new result, a new product capable of uses to which earlier products could not be put has resulted from this invention. For example, gratings constructed according to the principles of this invention can be used essentially indefinitely in highly corrosive areas, such as in paper pulping where strongly acid or strongly alkaline solutions are common, in the food industry where corrosion is a serious problem and cleanliness is an essential prerequisite, in the raising of hogs where corrosion and abrasion by hooves has heretofore presented an almost insurmountable challenge, and in other highly corrosive areas. According to one aspect of the invention, increased safety results from gratings of the present invention in that edges and ends of gratings, steps made by use of the gratings and other structures, can be permanently and brilliantly colored by a different and more prominent color than the center elements of the grating. These differently colored elements are bonded to the grating in the same manner described with respect to the dowel and I-element bond.

Figure 11:
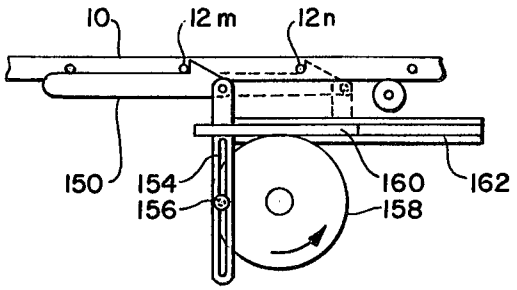
FIG. 11 is an enlarged partial cross-section of a portion of the machine shown in FIG. 10 taken along lines 11—11 in the direction of the arrows showing means for moving the grating through the machine during assembly.

FIGS. 10 and 11 depict an apparatus for manufacturing the gratings which have been described. The overall apparatus is best shown in FIG. 10 and comprises a pair of spaced apart support beams 102 and 104 which are supported in any convenient manner an appropriate distance above the floor of the building in which the apparatus is installed. In FIG. 10, four legs 106 and 108 on one side and 110 and 112 on the other side support the pair of beams 102 and 104. The legs may be secured to a plate, angle iron or other base, such as shown at 114 in FIG. 10 or may simply be secured to the floor in any convenient manner. The beams 102 and 104 are in parallel spaced apart relationship and they carry a plurality of support rollers extending between the two beams, such as depicted at 116, the ends of the rollers being carried in bearings such as depicted at 118 and 120.

The preassembled, but unglued, grating is carried on the rollers 116 of which there are a large number mounted in the same manner but spaced apart along the length of the apparatus. Exemplary of such rollers are those indicated at **116*b* and 116*c*. It is necessary to align the beams of the grating as the grating moves through the apparatus. A roller assembly indicated at 122 which includes a series of bobbins rotatably mounted between the beams 102 and 104. The bobbins may be fixed to or integral with the shaft and the roller 122** or may be rotatably fitted on a shaft. The purpose of the rollers is to space the beams of the grating apart, usually equidistant one from another. Of course, the gratings may be spaced at any desired distance. A stationary bar, typically a square bar, is positioned next to effectively hold the grating beams in a vertical position and to assure that the upper surface of each of the beams lies on the same line.

As the grating passes this point, it is preassembled, the beams are spaced and in the proper position and the dowels are in position through the beams. The dowels may be all the way in position, if the capillary flow of the glue is to be relied upon solely, or may be spaced a small distance, e.g., from ⅛ to ¼ inch, from the final position so as to be pushed into place following application of the glue. The entire grating is then heated and it passes through a pair of heaters 128 and 130. The heaters 128 and 130 include a numnber of radiant heating elements, such as the conventional Calrod elements used throughout industry, indicated at 132*a*, 132*b*, etc., and a similar type of heating element may be used in the lower heater as indicated at 134*a*, 134*b*, etc. The beam and dowel rod elements of the grating are pre-heated to a temperature above the optimum flow temperature of the flue which is to be used, typically above 140° F. The grating is clamped in place by means of a pair of clamp bars 136 and 138 which also assures the vertical alignment of the bars while the glue is applied simultaneously to each portion of the dowel rod adjacent each beam by means of a multiplicity of glue injection nozzles, 140*a*, 140*b*, etc., and 142*a*, 142*b*, etc. These nozzles are off-the-shelf hardware items available from various vendors and apply a pre-determined carefully metered, quantity of glue to the dowel rod-beam intersection as each such intersection moves to the glue position.

In one embodiment, the glue is applied to the dowel rod, then while the glue is still very fluid and the dowel rod and beams are hot, the dowel rod is shoved laterally so as to position the point of glue application interiorly of the hole in the beam. This assures the glue distribution in the right location. However, it has been found through experience that the low viscosity, high flow characteristics of the glue at higher temperatures, above 140° F., makes it possible to assemble the gratings simply by applying the glue to the intersection of the dowel rod with the hole in the beam and relying upon the capillary flow action of the glue to fill the space between the dowel rod and the interior of the hole of the beam.

Following application of the glue, the grating moves to a position where the curing or setting of the glue takes place. The curing or setting may be accelerated by additional heaters 144 and 146, constructed in the same manner as 128 and 130, placed above and below the grating. The heaters may be supported by posts 148 and 150 and like posts on the other. These posts may, of course, also be used to support the beams 102 and 104 and typically would be used for this purpose. Heaters 144 and 146 are not required in all instances and, indeed, it is often desirable to allow the residual heat in the components themselves to act as the curing energy for the glue. The glue sets to a rigid, relatively strong bond within a few seconds, or at most a few minutes, so that the grating can be handled. The grating is usually removed and placed in storage for at least twelve hours to permit final cure of the glue to take place before packing and shipping of the grating.

The grating is pulled through the apparatus in a step-by-step manner by a mechanism, shown in greatest detail in FIG. 11, which engages the dowel pins and pulls the grating through the apparatus. Two or more ratchet-like hook elements 150 and 152 move reciprocally in the direction of movement of the grating. The hook portions of these elements engage the dowels, such as is shown at 12*m* in FIG. 11, pull the grating a predetermined distance forward, and then return to pick up another dowel, shown at 12*n*. The reciprocal movement may be accomplished by any mechanism. In the particular embodiment illustrated, a bell-crank mechanism including a slotted lever 154, in which a pin 156 rides up and down as it rotates on wheel 158 is utilized. The reciprocal movement of the ratchet hooks is controlled by a guide 160 which moves reciprocally in a track 162. Obviously, a bell-crank mechanism is only one of a very large number of mechanisms which may be utilized to accomplish stepwise incremental movement of the grating through the apparatus.

The apparatus functions in the following manner. The grating beams which have been predrilled at predetermined intervals, are placed on edge on an assembly table. The dowel pins are shoved through the holes which are aligned on the assembly table and the entire partially assembled grating is moved to the apparatus shown in FIG. 10. If desired, a step-by-step moving mechanism, such as depicted in FIG. 11, may be included in the machine at some point before the heaters. Such a mechanism would work in the same manner as previously described, the only difference being that it would pick up the grating sooner and move it through the apparatus. As the grating moves through the apparatus, the grating components, the beams and the dowels are pre-heated in the heaters 128 and 130 to a temperature above about 140°, where the glue becomes a low viscosity, highly fluid material which will flow by capillary action. As the grating moves out of the heater, in stepwise fashion as described, the junction of the dowel rods and the beams stops beneath the glue nozzles. A predetermined, carefully metered amount of glue is applied at the point where the dowels intersect with the holes in the beams. At temperatures above about 140°, the glue is highly fluid and flows by capillary action between the outer surface of the dowel rod and the inner surface of the hole in the beam to form a seal between the dowel rod and the beam. In one embodiment, the dowel rod is moved laterally to assure that the glue flow completely fills the space. The glued joint is then moved a step further and the new joint is placed under the nozzle station. The residual heat in the elements is usually sufficient to complete the setting and the cure. If additional heating is desired, or if a quicker set is desired, additional heaters, such as 144 and 146, are included in the apparatus.

The grating is then removed from the apparatus and stored for such period of time as may be required to complete the cure of the glue before the grating is subjected to rough handling.

As shown in FIGS. 12, 13 and 14, the grating may also be assembled by inserting dowel rod elements 30, which are hollow or may contain roving, fiber rope or other flexible elongate strengthening structure, through holes in the beams 10 and thereafter enlarging the dowels adjacent each side of the beams to thereby lock the beams in place. Rigid dowel rods may also be used but this method is most advantageously used with flexible dowel rods to form a grating which can be rolled and, therefore, stored and shipped more easily and, more importantly, inserted through small passageways, such as manholes in process equipment or into channels and tunnels. Expansion may be by application of heat and plastic flow, and may be augmented by applying pressure inside the dowel rod structure. The clamp elements 32 and 34 confine the dowel rod structure in all areas except adjacent the beams and may apply heat, thereby forcing the dowel rod to be expanded adjacent to the beams to lock the beams in spaced parallel relationship one to another.

FIG. 15 depicts an alternative embodiment of the beams used in this invention. In this embodiment, a fabric belt 200 forms the central core section of the I-beam and is enclosed on both sides by a multiplicity of individual rovings indicated at 202*a*, 202*b*, etc. All of the rovings and the central core belt are bonded together in the usual pultrusion method by epoxy or polyester resin. The use of the central belt, which is a nonwoven fabric made up of glass fibers, greatly increases the resistance of splitting of the beams with minimal effect upon the tensil strength of the glass fiber reinforced resin beams.

It will be understood that the principles of this invention are applicable to many products and product lines and variations of products and product lines which are not specifically discussed. For example, one important use of the principles of this invention is the production of nose pieces for grating stairs which are brightly colored and/or include abrasive or gripping surfaces. In one form, these nose pieces can be made reversible, i.e., can be used with either side up so that as the abrasive particles wear out on one side the other side can be turned up.

There is virtually no end to the colors and color combinations which can be produced using the techniques of this invention, all without risking contamination from flaking or chipping paint. Special colors to meet OSHA requirements, indicate the presence of radioactive materials, and other special signal color combinations are easily and efficiently produced and become a permanent part of the installation.

In addition to industrial applications, such as stairs, walkways, supports for liquid-solid and fluid-solid contactors, and the like, the gratings of this invention find great application in salt-water environments, such as in docks, gangways, off-shore drilling installations, marinas, slips, and the like where a combination of bright and distinctive colors and chemical and corrosion resistance are important or useful.

The preceding disclosure is exemplary, only, and not limiting. Many variations in technique and composition are possible and well within the scope of the invention. Variations in the exact order of the steps of the process, the compositions, the handling techniques, etc., are only a few variations which are within the scope of the invention as defined in the claims.

We claim:

1. A method of manufacturing a grating constructed of resin bonded fibers, comprising the steps of:

extending a plurality of dowels through registered apertures in a plurality of I-elements, said apertures being substantially the same size as the cross-sectional size of the dowels;

applying to the dowels adjacent to the I-elements a heat setting adhesive which has a long pot life of about an hour or more at ambient temperature and which becomes highly fluid for several seconds and then heat sets in several seconds when heated to a flow temperature of about 100° F. or more;

heating the dowel and I-element intersection areas, including the adhesive, to said predetermined flow temperature to thereby cause the adhesive to become highly fluid thereby wetting the surface of the dowel and flowing by capillary action into the interior of the aperture in the I-element and thereafter heat setting to bond the dowel to the I-element.

2. The method of claim 1 wherein the dowel is moved relative to the I-elements through which it extends such that the portions of the dowel to which the adhesive was applied is within the aperture in the I-element, said movement being made after the adhesive becomes highly fluid and before the adhesive heat sets.

3. The method of claim 2 wherein the I-elements include an upper surface which comprises gripping material selected from the group consisting of abrasive particles and elastomeric materials.

4. The method of claim 2 wherein the dowels extend alternately through resilient support members and I-elements, the support members extending below the lower level of the I-elements to thereby support the entire grating, when in use, above the floor and provide omnidirectional drainage.

5. The method of claim 2 wherein the dowels extend and dead-end into an aperture in an end piece which has a larger cross sectional area than the cross sectional area of the I-element and are adhered thereinto by said adhesive.

6. The method of claim 5 wherein the end piece is colored differently and more prominently than the I-elements.

7. The method of claim 2 wherein the ends of the I-elements extend and dead-end into a channel in an edge piece and are adhered thereinto by said adhesive.

8. The method of claim 2 wherein the ends are differently and more prominently colored than the I-elements.

9. The method of claim 2 wherein the dowel is resilient to thereby permit the grating to be rolled.

10. The method of claim 1 wherein the I-elements include an upper surface which comprises gripping material selected from the group consisting of abrasive particles and elastomeric materials.

11. The method of claim 1 wherein the dowels extend alternately through resilient support members and I-elements, the support members extending below the lower level of the I-elements to thereby support the entire grating, when in use, above the floor and provide omnidirectional drainage.

12. The method of claim 1 wherein the dowels extend and dead-end into an aperture in an end piece which has a larger cross sectional area than the cross sectional area of the I-elements and are adhered thereinto by said adhesive.

13. The method of claim 12 wherein the end piece is colored differently and more prominently than the I-elements.

14. The method of claim 1 wherein the ends of the I-elements extend and dead-end into a channel in an edge piece and are adhered thereinto by said adhesive.

15. The method of claim 1 wherein the ends are differently and more prominently colored than the I-elements.

16. The method of claim 1 wherein the dowel is resilient to thereby permit the grating to be rolled.

17. The method of claim 1 wherein said heating step comprises preheating said pre-assembled dowels and I-elements to at least said flow temperature.

* * * * *

REEXAMINATION CERTIFICATE (537th)

United States Patent [19] [11] B1 4,244,768

Wiechowski et al. [45] Certificate Issued Jul. 22, 1986

[54] METHOD OF MANUFACTURING A GRATING CONSTRUCTED OF RESIN BONDED FIBERS

[75] Inventors: Joseph W. Wiechowski, San Clemente; Delmar S. Miller, Newport Beach; Richard C. Kostner, Orange, all of Calif.

[73] Assignee: Poly-Trusions, Inc., Newport Beach, Calif.

Reexamination Request:
No. 90/000,475, Dec. 5, 1983

Reexamination Certificate for:

| | |
|---|---|
| Patent No.: | **4,244,768** |
| Issued: | **Jan. 13, 1981** |
| Appl. No.: | **863,766** |
| Filed: | **Dec. 23, 1977** |

[51] Int. Cl.[4] ..... E04C 2/22; E04C 2/42

[52] U.S. Cl. ..... 156/293; 52/180; 52/181; 52/667; 156/279; 156/303.1; 156/305; 156/330; 428/119

[58] Field of Search ..... 156/293, 305, 330; 52/667

[56] References Cited

U.S. PATENT DOCUMENTS

| | | | |
|---|---|---|---|
| 2,190,214 | 2/1940 | Nagin | 52/669 |
| 2,895,389 | 7/1959 | Nagin | 94/5 |
| 3,674,110 | 7/1972 | Cooke | 182/46 |
| 3,710,529 | 1/1973 | Pass | 52/666 |
| 3,778,892 | 12/1973 | Ostroski | 29/598 |
| 3,967,091 | 6/1976 | Vaughan | 219/92 |
| 3,983,668 | 10/1976 | Hassman | 52/177 |

OTHER PUBLICATIONS

*Plastics Engineering Handbook* (3rd Ed.) A. F. Randolph Ed. (1960), Ch. 22, pp. 479–491.

*Modern Plastics*, "Making It A Lot Easier with Modular RP Pultrusions", (Jul., 1975), p. 30.

*Treatise on Adhesion and Adhesives*, vol. 4 (Structural Adhesives with emphasis on Aerospace Applications, Robert L. Patrick, Ed., (1976) Ch. 6, pp. 95–97.

Bamberg, *Insulation, Fabricating Fiber Glass Mat Reinforced Plastics*, Parts I and II, 11 pages, Lake Pub. Corp., 1958.

Advertising Brochure, *Poly-Trugrating*, Poly-Trusions, Inc., Mar. 15, 1975.

IKG Industries, *Fiberglass Reinforced Plastic Grating*, Materials Manufacture Markets, (undated, but prepared and distributed at Materials, Manufacture and Markets Conference in Biloxi, Mississippi, Spring, 1976.

*Primary Examiner*—Michael G. Wityshyn

[57] ABSTRACT

A resin bonded glass fiber grating adhesively bonded together in unitary construction to form a lightweight, high strength industrial grating, which may include a non-skid elastomer surface and the capability to be rolled up for storage and a method of constructing the same.

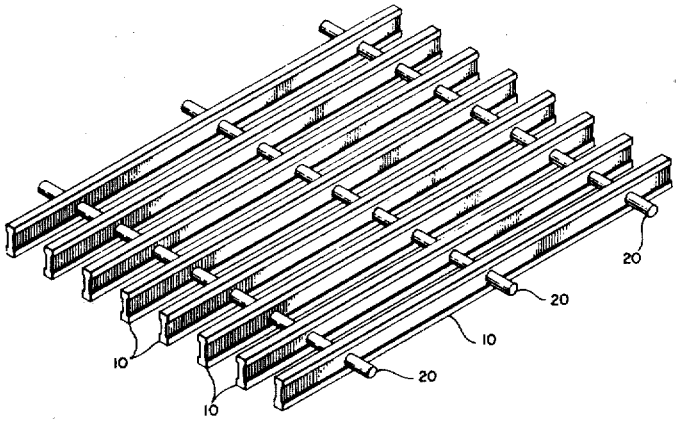

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–17 are cancelled.

* * * * *